United States Patent [19]

Neuer et al.

[11] Patent Number: 4,648,249

[45] Date of Patent: Mar. 10, 1987

[54] NEEDLE SELECTING ARRANGEMENT FOR KNITTING MACHINES

[75] Inventors: Andreas Neuer; Eberhard Grimmer; Hartwig Müller, all of Karl Marx Stadt, German Democratic Rep.

[73] Assignee: VEB Kombinat Textima, Karl Marx Stadt, German Democratic Rep.

[21] Appl. No.: 794,240

[22] Filed: Nov. 1, 1985

[30] Foreign Application Priority Data

Nov. 1, 1984 [DD] German Democratic Rep. ... 268991

[51] Int. Cl.[4] ..... D04B 7/00

[52] U.S. Cl. ..... 66/75.2

[58] Field of Search ..... 66/75.1, 75.2

[56] References Cited

U.S. PATENT DOCUMENTS

| | | | |
|---|---|---|---|
| 3,699,789 | 10/1972 | Hadam | 66/75.1 |
| 3,955,381 | 5/1976 | Panchaud | 66/75.1 |
| 4,196,599 | 4/1980 | Guell | 66/75.2 |
| 4,214,460 | 7/1980 | Shima | 66/75.2 |
| 4,490,994 | 1/1985 | Essig | 66/75.1 |

FOREIGN PATENT DOCUMENTS

| | | |
|---|---|---|
| 2842054 | 5/1979 | Fed. Rep. of Germany . |
| 2939639 | 4/1980 | Fed. Rep. of Germany . |

*Primary Examiner*—Ronald Feldbaum
*Attorney, Agent, or Firm*—Striker, Michael J.

[57] ABSTRACT

A needle selecting arrangement for a knitting machine with a knitting and stitching transmitting cam and a plurality of electromagnetic selecting elements, the arrangement comprises a plurality of spring biased needles each having a needle shaft; comprising at least one switchable displacement cam part arranged to move in front of the knitting and stitching transferring cam; a plate cover having a lower edge and a plurality of openings which are arranged in a stepped manner in association with the selecting elements and normal to a needle bed plane; an arresting rail provided with a plurality of grooves; a plurality of plates having a first side which faces toward the needles and provided at the first side with a substantially spherical end arranged to abut against the needle shaft and with a plate foot cooperating with the displacement cam part, each of the plates having an opposite second side which is fork-shaped and is provided with cam projections for tensioning against the lower edge of the plate cover and engageable into the grooves of the arresting rail in a position-changeable pivotable manner; means forming a plurality of plate tracks in operating region of the displacement cam part; and a plurality of selecting pins arranged to abut loosely against a respective one of the plates and extending in correspondence with a selection through a respective one of the openings of the plate cover; and a plurality of pressure cam parts turnable by the electromagnetic selecting element and arranged so that the selecting pins cooperate with the pressure cam parts.

21 Claims, 7 Drawing Figures

F I G. 1
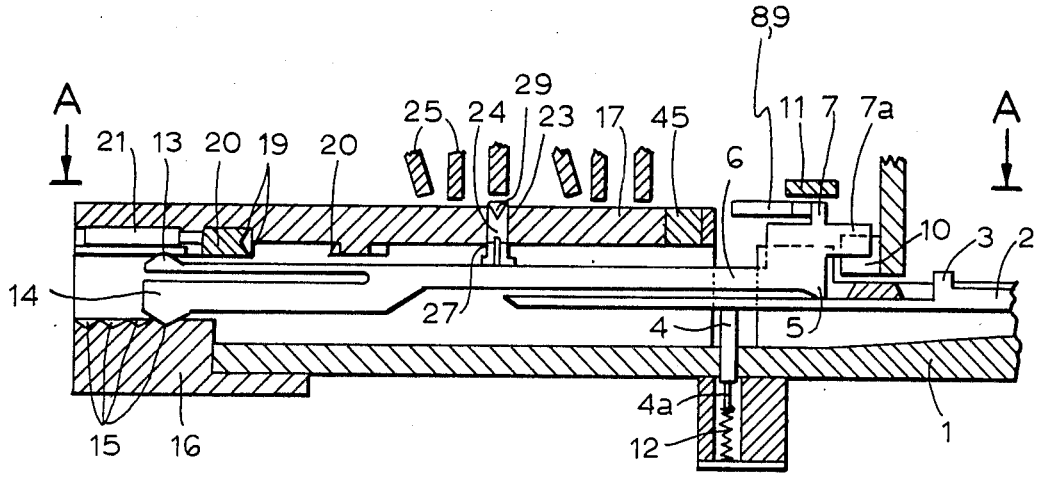
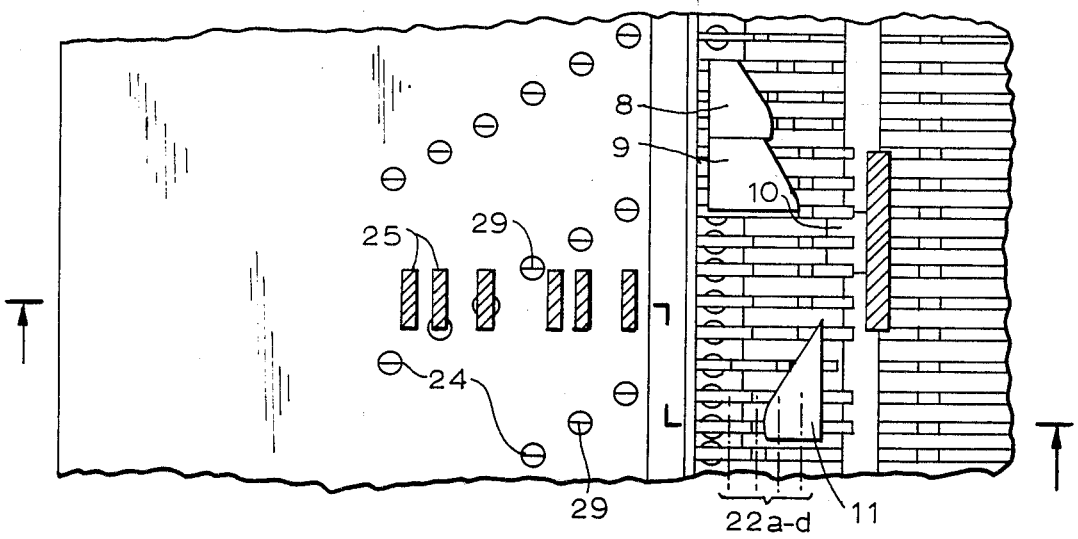
F I G. 2

FIG. 3
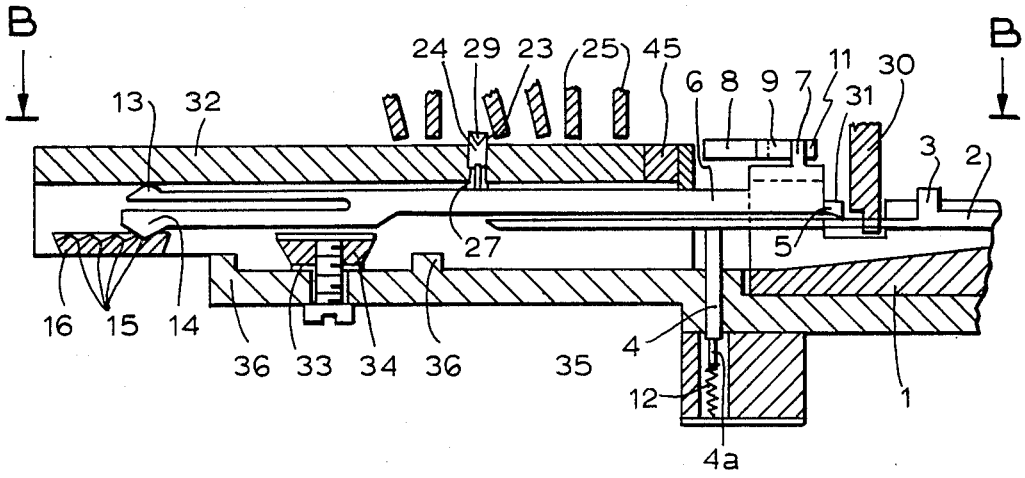
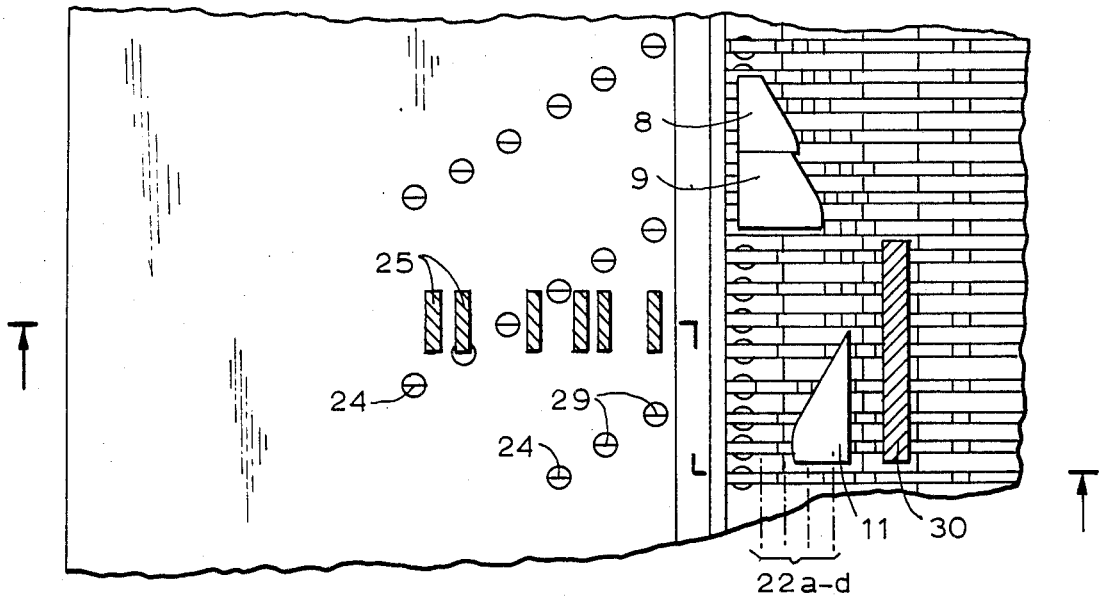
FIG. 4

FIG. 5
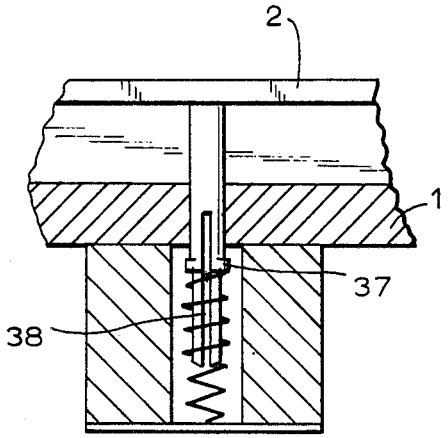
FIG. 6
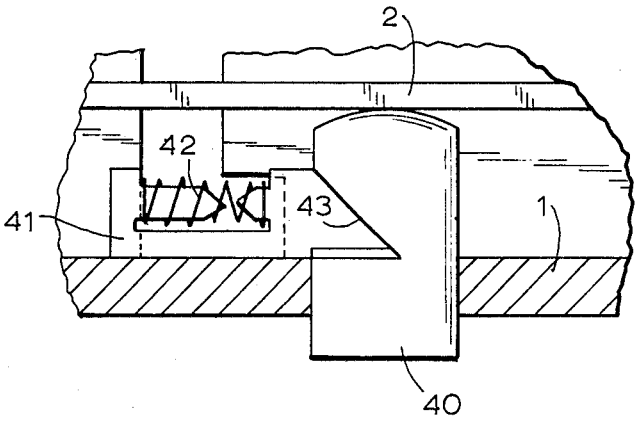
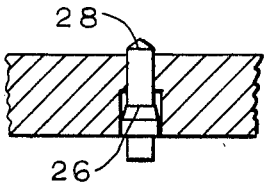
FIG. 7

NEEDLE SELECTING ARRANGEMENT FOR KNITTING MACHINES

BACKGROUND OF THE INVENTION

The present invention relates to a needle selecting arrangement for knitting machines. More particularly, it relates to a needle selecting arrangement for such knitting machines which are provided with electromagnetic selecting elements, pressure strips and cam parts associated with the knitting systems and assembled in blocks, for selective actuation of needles, and also with a plurality of plates which are displaceable in the direction of elongation of the needles and act upon the needles. They are used especially in flat knitting machines with a reciprocating or single acting knitting systems, and can also be modified to be used for round knitting machines.

Needle selecting arrangements of this type are known in the art. In known needle selecting arrangements the electromagnetic selecting elements act via rockers on plates which are formed with a needle pusher and which act on the needles. The plates are pressed by a switchable pusher cam in different tracks and enable the selection of needles in fully extended, catching and not knitting positions. The disadvantage of this construction is, however, that significant space is required for actuation of the rockers and for the pusher cam, whereby the needle beds must be provided with very long passages and also with very large knitting carriages.

The DE-OS No. 2,842,054 discloses a needle selecting arrangement in which the needles during the knitting can be selected by needle plates which move in a longitudinal direction of the needles and are pressable in a springy manner in a needle bed, a pre-pressing member which acts upon the needle plates is engageable in several tracks, and selection plates are located above the same and actuatable by adjusting members associated with the knitting carriage, for forming stitches, catch hooks or floating threads. The adjusting members are arranged in a stepped manner in the knitting carriage and each adjusting member is located against the foot of a selecting plate. The insertion of the pre-pressing member into the desired track as well as displacement of it to its basic position is performed by special cam parts additionally arranged in the knitting carriage. This solution is very expensive because of many cooperating members from the selecting plate to the needle, which are arranged in the needle bed partially behind one another and over one another and act individually, and whose position must be secured. The cam has a complicated construction and a very long needle bed is required. Even smallest tolerance deviations between the needle bed and the knitting carriage can lead to false switches.

Finally, the DE-OS No. 2,939,639 also describes a selecting arrangement in which a plate located in each needle passage is actuated by electromagnet adjusting member and simultaneously serves for direct needle control. For differentiating the needles which make the stitches and the hooks or retaining them in non-operative condition, a two-step selection is required in the knitting cam and thereby two selecting blocks are needed for each knitting system. This means that high expenses are involved in the control electronic circuitry for this selecting system.

All above described solutions have the same disadvantage that the plate bed must be maintained clean, with great difficulties, for avoiding impurities of the adjusting members which move over the plate bed, since otherwise the impurities would affect their operational accuracy.

SUMMARY OF THE INVENTION

Accordingly, it is an object of the present invention to provide a selecting system for knitting machines, which avoids the disadvantages of the prior art.

More particularly, it is an object of the present invention to provide a selecting arrangement for knitting machines, which involves lower technical and material expenses and in which the needle selection is performed in a simple manner which higher reliability and allows a three-way technique and stitch transfer in both directions.

It is also an object of the present invention to provide such a selection system in which all mechanical parts are simple to manufacture and easily selectable, and at the same time require a low maintenance.

In keeping with these objects and with others which will become apparent herein after, one feature of the present invention resides, briefly stated, in a needle selecting arrangement for a knitting machine, which has a plurality of plates provided at their side facing toward the needle with a spherical end abutting against a needle shaft and with a plate foot for cooperating with at least one displacing cam part which is switchable and is arranged in front of knitting and stitching transferring cam, each plate is fork-shaped at its other side and is provided at the other side with a cam projection for tensioning against a lower edge of a plate cover, and an arresting rail is mounted on a needle bed and has a plurality of grooves for forming position-changeable pivot points for the cam projections of the plates, a plurality of plate tracks are formed in operating region of the displacing cam part, a plurality of selecting pins lie loosely on the plates and extend through openings which are provided in the plate cover and arranged in correspondence with the number of the electromagnetic selecting element in a stepped manner and normal to the needle bed plane, and pressure cam parts are turnable by the electromagnetic selecting elements and with which the selecting pins are in operating connection.

When the needle selecting arrangement is designed in accordance with the present invention, it attains the above mentioned objects. The plates required for the needle selection with their support and cooperation with the stitching needles are used with maintaining of known cam and pressure strip system for pressing back the plates. With the utilization of a low number of mechanical intermediate members and the actuation of the electromagnetic selecting elements, a reliable performance of the selected stitching functions is guaranteed. The number of the selections in each knitting system is limited to a minimum. The disturbing influence of dirt because of fiber wear and dust, mechanical vibrations of neighboring machine parts, and tolerances in the region of the needle bed and plate bed upon the selection system is avoided.

In accordance with another feature of the present invention the plates are provided with a lifting projection which is arranged at their end facing toward the needles and is actuated by the lifting cam parts.

For mounting the plate cover on the needle bed, the plate cover is provided at its lower side and a needle bed web is provided at its upper side with Z-shaped interengaging projections, and a clamping rail with a clamping screw is guided on one of the projections. This function can also be performed by dovetail shaped recesses and dove-tail shaped clamping pieces, as well as by additional arrangement of projections.

For facilitating its working and improving its accessibility, the needle is subdivided in the region of the spring pins into several segments normal to the longitudinal direction of the needles and to the plate cover. The plate can be supported in a special plate bed, wherein the arresting rail in this case is inserted in dovetail shaped recesses of the plate bed. The plates can be provided at their ends which face toward the needles with a projection which cooperates with a turnable pressure strip. The plates can be unloaded by acting of this pressure strip upon the needles.

In correspondence with a further feature of the present invention, the spring pins provided for spring biasing of the needles have a downwardly reducing portion for pressing a first coil of a pressure string, or are provided with a longitudinal slot in their lower end. Also, the spring biasing of the needles can be performed by two pressure pieces which are movable relative to one another substantially normally and have a common contact surface, and a pressure spring acting upon the pressure pieces.

A flat spring can be provided for pressing the cam projections on one plate end into the groove of the arresting rail. The arresting formations can be arranged on the lower side of the rear end of the plates. The arresting formations must engage in an arresting element which is loaded by a spring force.

Finally, for avoiding dirtying of the electromagnetic selecting elements and therefore false switching, the knitting carriage can be provided with brushes or other equivalent means for cleaning the upper edge of the plate cover.

The plates can be stabilized in their selected positions, for example by an adherence magnet arranged on the knitting carriage in the region of the plate foot. In accordance still a further feature of the present, the selecting pins can be provided with a conical portion in their central region or with a projection having a longitudinal slot at the lower end. They also can be provided at their upper end with at least one abutment incline or a conical formation.

The novel features which are considered as characteristic for the invention are set forth in particular in the appended claims. The invention itself, however, both as to its construction and its method of operation, together with additional objects and advantages thereof, will be best understood from the following description of specific embodiments when read in connection with the accompanying drawing.

BRIEF DESCRIPTION OF THE DRAWING

FIG. 1 is a view showing a cross-section of a knitting machine through a needle and plate bed;

FIG. 2 is a view of the knitting machine as seen in direction A—A;

FIG. 3 is a view showing a cross-section of a further embodiment of the inventive knitting machine with a special needle and plate bed;

FIG. 4 is a view showing the knitting machine of FIG. 2 as seen in direction B—B;

FIG. 5 is a view showing a further embodiment of a spring pin;

FIG. 6 is a view showing a needle biasing by means of pressure pieces and a pressure spring; and FIG. 7 is a view showing a further embodiment of a selecting pin.

DESCRIPTION OF PREFERRED EMBODIMENTS

In a knitting machine in accordance with the present invention, needles 2 with needle feet 3 are arranged in a known manner in a needle bed 1. The needles have a shaft which is supported in a springy manner by a spring pin 4. The spring pins 4 are provided with a downwardly reducing portion 4*a*. During insertion of the spring pin from above the first coils of a pressure spring 12 is pressed by the spring pin 4 via the portion 4*a*. The pressure spring 12 thereby expands and forms an abutment for limiting the path of the spring pin.

A spherical end 5 of a plate 6 which is also supported in the needle bed 1 abuts against the shaft of each needle 2. Each plate 6 is provided with a plate foot 7 and a lifting projection 7*a* which cooperates with pressure strips located on a knitting carriage, as well with displacement cam parts 8, 9, 11 arranged in front of a knitting and stitching overhanging cam and a lifting cam part 10. The plates 6 have ends which face away of the needles 2 and are fork-shaped. These ends are provided with cam projections 13, 14, 24. The cam projection 14 serves as a pivot point of the plate 6 since it engages in one of grooves 15 provided on arresting rails 16 which are mounted on the needle bed 1. The arresting rail 16 is provided with four grooves 15. Depending on the engagement of the cam projection 14 in one of the grooves 15, the plate foot 7 is located in one of plate tracks 22*a*–22*d*. In correspondence with the position of the plate 6 in the plate tracks 22*b*–22*d*, there is provided via the knitting cam a full extension, a catching extension, and an extension in stitch delivering or stitch receiving position, or no movement of the needles. The position of the plates 6 in the plate track 22*a* is provided for fixedly arresting the associated needles 2 in out-of-work position. The displacement of the plates 6 in this track is performed either manually or by a special, not-shown cam part.

The cam projection 13 abuts against a plate cover 17. Z-shaped projections 18 and 19 are provided on the lower surface of the plate cover 17 and on the upper surface on a needle bed web for arresting the plate cover. The projections 18 engage directly with one another. As for the projection 19, a clamping rail 20 is located between these projections. The clamping rail 20 is provided with clamping screws 21 for tensioning of the plate cover 17. The plate cover 17 has openings 23 for selecting pins 24 which loosely lie on the plates 16. The openings 23 are arranged in groups in a stepped manner in correspondence with the number of the electromagnetic selecting elements located in a block and pressure cam parts 25 actuated by the latter.

The selecting pins 24 can be inserted into the openings 23 either before or after the mounting of the plate cover 17. In the event of their insertion before the mounting of the plate cover 17, they are provided in their central region with a conical portion 26 which acts for clamping the selecting pins 24 in the openings 23. In the event of their insertion after mounting of the plate cover 17, the selecting pins 24 are inserted with their longitudinally slotted lower end provided with a lower stop 27. The end of the selecting pins 24 is thereby compressible so that the stop 27 can unobjectionably pass through the opening 23. The selecting pins 24 can be provided on their upper end with a conical tip 28 shown in FIG. 7 or with at least abutment incline 29 shown in FIG. 1, for cooperating with the pressure cam parts 25.

By the upwardly extending plate cover 17, it is possible to hold its surface free from dust, fuzz and similar impurities. These impurities thereby do not take place on the sensitive electromagnetic selecting elements, whereby false switching because of their selection is avoided.

In the needle selecting arrangement with needle and plate support in accordance with the embodiment shown in FIG. 3, a special plate bed is provided for the plates 6. The plate bed 32 has a dove-tail shaped recess 33 and is connected with a pin rail 35 via a clamping piece 34. An additional positional safety of the plate bed 32 is obtained by a rectangular projection 36 on the pin rail 35. The arresting rail 16 can be inserted into the dove-tail shaped recess of the plate bed 32 or mounted on the pin rail 35. The plate 6 has no lifting projection 7*a* and it is not provided with a lifting cam part 10. The unloading of the plate 6 for its selection is performed by with drawing of the needle by means of a pressure strip 30. It is to be understood that further modifications of the structural elements of the needle selecting device are possible. For example, it is possible to subdivide the plate cover 17 into several segments and/or to separate the structural unit of the needle and plate bed 1 of FIG. 1 in the region of the spring pins 40, for facilitating mounting and reducing expenses during exchange of the selecting pins 24. The spring pin 4 can be provided in its lower region with a stop 37 and a longitudinal slot 38 for simplifying its mounting.

A further possibility of the needle springing is, for example, to use a prestressed flat shaped spring or a combination of two pressure pieces 40 and 41 with a pressure spring 42 as shown in FIG. 6. These both pressure pieces 40 and 41 must be provided each with a common contact surface 43. The contact surface 43 during vertical movement of the pressure piece 40 acts for a horizontal movement of the pressure piece 41 against the force of the pressure spring 42 in the longitudinal direction of the needle.

Instead of slotting the plate 6 at its end which faces away of the needles 2, it is possible to obtain the springy action by a flat shaped spring. Finally, it is also possible to provide the plate 6 itself with arresting formations which engage in a special arresting element loaded by a cylinder pressure spring or a flat spring with a spring force.

For needle selection in the needle and plate bed construction of FIGS. 1 and 2, the plates 6 are first brought to one or two desired plate tracks 22*b*–22*d* by means of the displacing cams 8 and 9 which are switchable by a control device of the knitting machine. In particular they are brought from an edge track into a central track and then to another edge track. After this, the plates 6 reach a selected condition by the lifting cam part 10 which engages under the projection 7*a*, and in this condition they are no longer in contact with the needle shafts. The selecting pins 24 extend outwardly beyond the openings 23 of the plate cover 17 and reach the operating region of the pressure cam parts 25. The pressure cam parts 25 are turnable in correspondence with their actuation by the electromagnetic selecting elements.

By means of the relative movement between the needle bed 1 and the knitting system or systems, the pressure cam parts move over the stepped selecting pins 24. With the turned pressure cam parts 25, the plates 6 maintain their initial position. The other pressure cam parts 25 press the plates 6 in the needle bed 1. The plates 6 which remain in the initial position reach with their plate feed 7 in the operational region of the displacing cam part 11 which moves these plates in another plate track.

In order to guarantee that the selecting pins 24 which are not actuated by the pressure cam part 25 during the first selection remain stably in the selected position until the displacing cam part 11 is actuated, stabilization of their plates 6 is necessary. This is attained by a lateral bending of the plates 6 and by the additional arrangement of a permanent adherent magnet 45 in the knitting carriage in the region of the plate foot 7.

When the plate selection must be turned off, for example for maintaining the plate distribution or producing smooth knitting, the bringing of the plates 6 in the selected condition is prevented by switching over of the lifting cam part 10. The movement control of the needle groups selected in this manner is performed in a known manner by pressure strips which press the plates 6 and thereby the needles 2 completely or partially from the region of action of the knitting cam. If a plate control is required from a plate track 22*b*–22*d* in both other plate tracks, then the needle movement must be switched off in first of two required knitting or selecting systems. This is performed by switching over of the advancing parts in this knitting system or by switching over all plates selected on both first plate tracks and thereby also their needles 2 from the engaging region of the whole knitting cam.

In the embodiment shown in FIGS. 2 and 3, the plates 6 are provided with an abutment from above by the spring biased needle 2 so that it is pressed against the plate cover 17. For selection, the needle 2 can be pressed back by a pressing strip 30 and thereby the plate 6 is unloaded and brought in one of the desired plate tracks 22*b*–22*d* by the displacement cam parts 8, 9, 11. The switching-off of the selecting elements is performed in this case by coupling of the pressing back of the needle 2 with the plate 6 so that the pressing strip 30 is turned and therefore acts on its projection 31.

It will be understood that each of the elements described above, or two or more together, may also find a useful application in other types of constructions differing from the types described above.

While the invention has been illustrated and described as embodied in a needle selecting arrangement for a knitting machine, it is not intended to be limited to the details shown, since various modifications and structural changes may be made without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed as new and desired to be protected by Letters Patent is set forth in the appended claims:

1. A needle selecting arrangement for a knitting machine with a knitting and stitching transmitting cam and a plurality of electromagnetic selecting elements, the arrangement comprising a plurality of spring biased needles each having a needle shaft; at least one switchable displacement cam part arranged to move in front of the knitting and stitching transferring cam; a plate cover having a lower edge and a plurality of openings which are arranged in a stepped manner in association with the selecting elements and normal to a needle bed plane; an arresting rail provided with a plurality of grooves; a plurality of plates having a first side which faces toward the needles and provided at said first side with a substantiallv spherical end arranged to abut against the needle shaft and with a plate foot cooperating with said displacement cam part, each of said plates having an opposite second side which is fork-shaped and is provided with cam projections for tensioning against said lower edge of said plate cover and engageable into said grooves of said arresting rail in a position-changeable pivotable manner; means forming a plurality of plate tracks in operating region of said displacement cam part; and a plurality of selecting pins arranged to abut loosely against a respective one of said plates and extending in correspondence with a selection through a respective one of said openings of said plate cover; and a plurality of pressure cam parts turnable by the electromagnetic selecting elements and arranged so that said selecting pins cooperate with said pressure cam parts.

2. A needle selecting arrangement as defined in claim 1; and further comprising a lifting cam part, each of said plates having an end which faces toward the needles and being provided at said end with a lifting projection actuatable by said lifting cam part.

3. A needle selecting arrangement as defined in claim 1; and further comprising a needle bed in which said needles are embedded and which has a needle bed web with an upper such side, said plate cover having a lower side, said plate cover being provided at said lower side and said needle bed web being provided at said upper side with Z-shaped inter-engaging projections; and further comprising a clamping rail having a clamping screw and guided on one of said projections.

4. A needle selecting arrangement as defined in claim 1; and further comprising a needle bed in which said needles are embedded; and a plurality of spring pins for spring biasing said needles, said needle bed being subdivided in the region of said spring pins substantially normally to the direction of elongation of said needles.

5. A needle selecting arrangement as defined in claim 1; and further comprising a plate bed having a plurality of dovetail shaped recesses, said plates being supported in said plate bed, said arresting rail being inserted in said dove-tail shaped recesses of said plate bed.

6. A needle selecting arrangement as defined in claim 1; and further comprising a pressure strip which acts on said needles, said plates being unloadable via said pressure strip.

7. A needle selecting arrangement as defined in claim 6, wherein pressure strip is turnable, each of said plates having an end which faces toward the needles and being provided at said end with a projection for cooperating with said turnable pressure strip.

8. A needle selecting arrangement as defined in claim 1, wherein said plate cover is subdivided into a plurality of segments.

9. A needle selecting arrangement as defined in claim 1; and further comprising a needle bed for embedding said needles and provided with a needle bed web; and means for connecting said plate cover with said needle bed, said connecting means including a dove-tail shaped recess, a dove-tail shaped clamping piece cooperating with said recess, and a projection.

10. A needle selecting device as defined in claim 1; and further comprising a plate bed for embedding said plates and having a plate bed web; a plurality of spring pins arranged to spring bias said plates; a pin rail for accommodating said pins; and means for connecting said plate bed web with said pin rails and including a dove-tail shaped recess, a clamping piece cooperating with said dove-tail recess, and a projection.

11. A needle selecting arrangement as defined in claim 1; and further comprising a plurality of spring pins arranged to spring bias said needles, each of said spring pins having a lower end provided with a longitudinal slot.

12. A needle selecting arrangement as defined in claim 1; and further comprising a plurality of spring pins and a plurality pins each associated with a respective one of said spring pins so as to spring bias said needles, each of said springs having a first coil, and each of said spring pins having a downwardly reducing portion arranged to press against said first coil of a respective one of said springs.

13. A needle selecting arrangement as defined in claim 1; and further comprising means for spring biasing said needles, said means including two pressure pieces movable relative to one another and having a common contact surface, and a pressure spring arranged to bias said pressure pieces against one another.

14. A needle selecting arrangement as defined in claim 1, wherein said plates have a rear end; and further comprising a flat spring arranged between said rear end of said plate and said plate cover for pressing said cam projection into one of said grooves of said arresting rail.

15. A needle selecting arrangement as defined in claim 1; and further comprising means for stabilizing said plates in their selected position and including an adherence magnet arranged in the region of said plate foot of said plates.

16. An arrangement as defined in claim 1, wherein each of said selecting pins has a central region and is provided in said central region with a conical portion.

17. A needle selecting arrangement as defined in claim 1, wherein each of said selecting pins has a projection and a lower-end and is provided at its lower end with a longitudinal slot.

18. A needle selecting arrangement as defined in claim 1, wherein each of said selecting pins has an upper end and is conical at said upper end.

19. A needle selecting arrangement as defined in claim 1, wherein each of said selecting pins has an upper end and is provided at said upper end with at least one abutment incline.

20. A needle selecting arrangement as defined in claim 1 particularly for a knitting machine having a knitting carriage, said plate cover having an upper end; and further comprising means for cleaning said upper end of said plate cover and mounted mountable on the knitting carriage.

21. A needle selecting arrangement as defined in claim 20, wherein said cleaning means include a brush.

* * * * *